US005290143A

United States Patent [19]

Kington et al.

[11] Patent Number: 5,290,143

[45] Date of Patent: Mar. 1, 1994

[54] BICAST VANE AND SHROUD RINGS

[75] Inventors: Harry L. Kington, Scottsdale; Steven J. Pringnitz, Gilbert, both of Ariz.

[73] Assignee: Allied Signal, Morris Township, N.J.

[21] Appl. No.: 970,198

[22] Filed: Nov. 2, 1992

[51] Int. Cl.[5] ..... F04D 29/54

[52] U.S. Cl. ..... 415/191; 415/200; 415/915

[58] Field of Search ..... 415/208.1, 191, 200, 415/915

[56] References Cited

U.S. PATENT DOCUMENTS

| | | | |
|---|---|---|---|
| 3,857,649 | 12/1974 | Schaller et al. | 415/200 |
| 3,867,065 | 2/1975 | Schaller et al. | 415/200 |
| 3,966,353 | 6/1976 | Booher, Jr. et al. | 415/200 |
| 4,728,258 | 3/1988 | Blazek et al. . | |
| 4,987,944 | 1/1991 | Parks . | |
| 5,035,579 | 7/1991 | Yada et al. | 415/200 |
| 5,069,265 | 12/1991 | Blazek . | |
| 5,074,752 | 12/1991 | Murphy et al. | 415/191 |
| 5,083,900 | 1/1992 | Carletti et al. . | |

FOREIGN PATENT DOCUMENTS

| | | | |
|---|---|---|---|
| 38414 | 3/1979 | Japan | 415/208.1 |
| 205202 | 1/1968 | U.S.S.R. | 415/200 |

*Primary Examiner*—John T. Kwon

*Attorney, Agent, or Firm*—Jerry J. Holden; James W. McFarland

[57] ABSTRACT

A bicast vane and shroud rings is provided in which thermal stresses are minimized. The vane has a flange portion along its inner and outer edge. These flange portions extend from the mid-chord of the vane part way towards the leading and trailing edges and follow the camber of the vane. Each of the flange portions has a width greater than that of the vane so has to form an overhang or lip about which conventional shroud rings are cast. As the flange portions approach the leading and trailing edges their width decreases and the overhang blends into the inner and outer edge to form rounded tops and bottoms at the leading and trailing edge. These rounded tops and bottoms reduce stress concentrations in the shroud rings and increase shroud material near these edges. Additionally, a stress relieving member is provided that embraces the top and bottom edges of the thin trailing edge, and inhibits the melting of the trailing edge during bicasting.

11 Claims, 2 Drawing Sheets

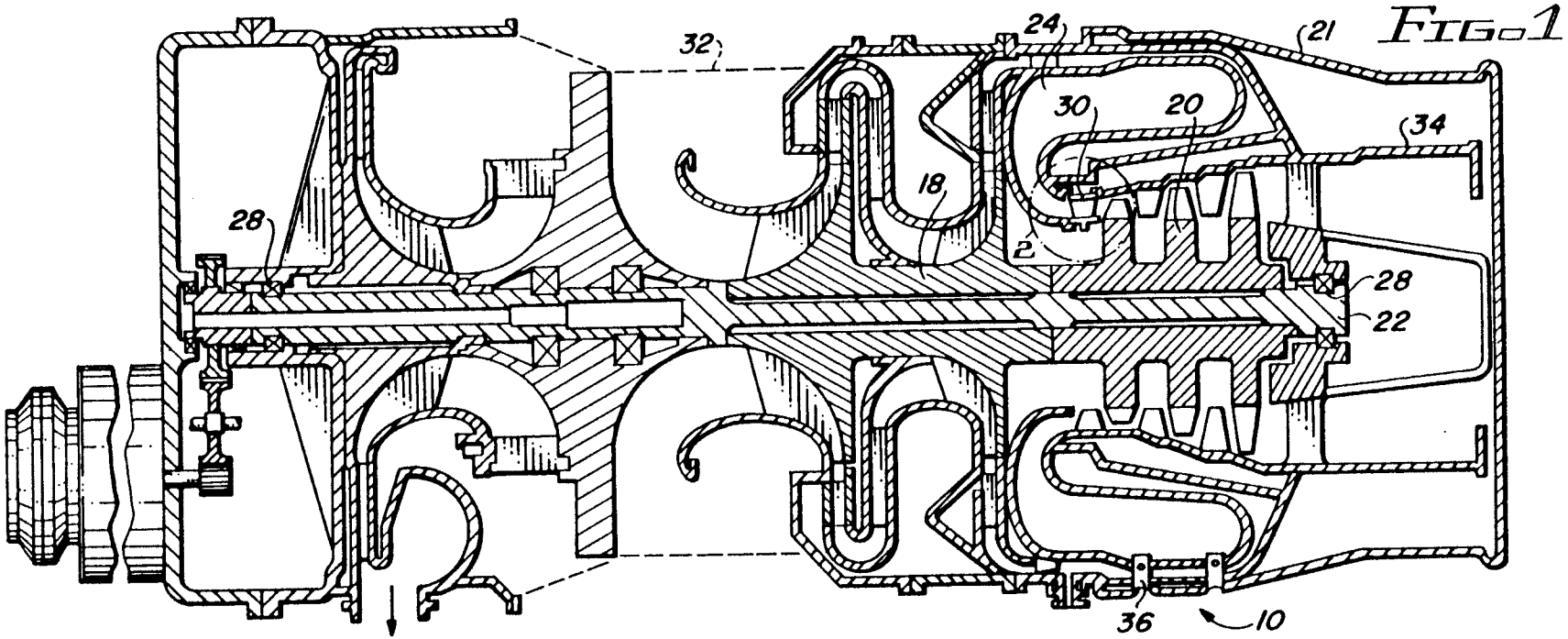
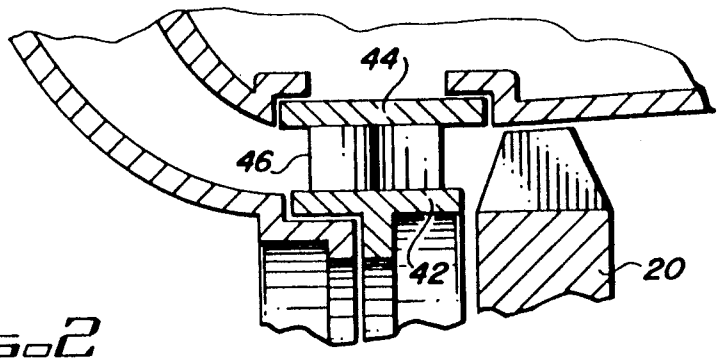
FIG. 2

BICAST VANE AND SHROUD RINGS

TECHNICAL FIELD

This invention relates generally to gas turbine engines, and in particular to an improved bicast turbine stator having vanes with flanged portions about which the shroud rings are cast resulting in lower thermal stresses in the vanes and improved structural integrity of the shroud rings.

BACKGROUND OF THE INVENTION

Gas turbine engines typically have stators to direct the compressed high temperature gas against the turbine blades. Stators are comprised of an annular array of airfoils or vanes interposed between inner and outer shroud rings. Usually, the three components are cast from the same material making the vane integral with the shroud rings at the top and bottom edges of the vanes. During transient conditions, such as start up and shut down of the engine, the gas temperature rapidly changes. Because a larger portion of the vane relative to the shrouds is exposed to the gas, it respond more quickly to the changes in gas temperature. Thus, when heated faster then the shrouds, the vanes become susceptible to large thermal compressive stress because the vanes want to expand but are constrained by the shroud rings. Similarly, when cooled, a large tensile stress is created across the vane which wants to contract.

The thermal stresses are particularly high in the thin, trailing and leading edges. The cyclic nature of the thermal stresses make the vanes highly susceptible to low cycle fatigue cracking. Therefore, it is desirable to have vanes with good low cycle fatigue properties which tend to be expensive.

Bicasting is another method of forming a turbine stator. This method includes casting shroud rings around the tip and root edges of prefabricated vanes. The advantage to bicasting is that the vanes and shroud rings can be formed from materials having different compositions and crystallographic structure. This permits the use of single crystal or columnar grained crystallographic vanes which have low elastic modulus and good low cycle fatigue properties in the direction of primary stress.

U.S. Pat. No. 4,728,258 discloses a bicast turbine stator having a vane configured for mounting with a slip joint between the vane and the shroud ring to accommodate the thermal expansion of the vanes. The slip joint is produced by printing or stamping through the shroud ring which reduces its strength. Also, with slip joints, the hoop stress in the shroud ring must be carried by the portions of the ring surrounding the slip joint and adjacent the leading and trailing edges of the vanes. Not only does this reduce the amount of material available for carrying the hoop stress but compounds the problem by producing large stress concentrations at the leading and trailing edges.

U.S. Pat. No. 5,069,265 discloses a bicast turbine stator in which the shroud ring is strengthened by the addition of a rail which carries a portion of the hoop stress. A space is maintained between the rail and the shroud ring to accommodate the thermal expansion of the vanes. However, the rail adds weight to the shroud ring, increases the thermal mismatch between the vanes and the shroud ring, and increases the thermal stress in the shroud ring.

Thus disadvantages to slip joints are reduced material available in the shroud ring for carrying hoop stress, stress concentrations adjacent the vanes leading and trailing edges, radial space taken by the shroud rings and rails, increased weight, increased thermal mismatch between the vanes and shroud rings, and increased thermal stress in the shroud rings.

Accordingly, there is a need for a stator vane that when bicast to shroud rings increases the stator's structural integrity, and reduces thermal stresses.

SUMMARY OF THE INVENTION

An object of the present invention is to provide a vane configuration that when bicast to shroud rings has lower thermal stress levels, particularly at its leading and trailing edges.

Another object of the present invention is to provide a bicast turbine stator having more material available for carrying hoop stress, smaller stress concentrations especially adjacent the leading and trailing edges of the vanes, and minimal radial thickness.

The present invention achieves the above stated objects by providing a bicast turbine stator in which the inner and outer edges of each of the vanes has a flange portion. These flange portions extend from the mid-chord of the vane part way towards the leading and trailing edges and follow the camber of the vane. Each of the flange portions has a thickness greater than that of the vane so has to form an overhang or lip about which conventional shroud rings are cast. As the flange portions approach the leading and trailing edges their thickness decreases and the overhang blends into the inner and outer edge to form rounded tops and bottoms at the leading and trailing edge. These rounded tops and bottoms reduce stress concentrations in the shroud rings and increase shroud material near these edges. Another feature of the present invention is a stress relieving member embracing top and bottom edges of the thin trailing edge, which also inhibits the melting of the trailing edge during the bicast process.

These and other objects, features and advantages of the present invention, are specifically set forth in, or will become apparent from, the following detailed description of a preferred embodiment of the invention when read in conjunction with the accompanying drawings.

BRIEF DESCRIPTION OF THE DRAWINGS

FIG. 1 is a partial schematic, cross sectional view of a gas turbine engine incorporating the present invention.

FIG. 2 is an enlarged view of a portion of FIG. 1 represented by the dashed circle 2.

DESCRIPTION OF THE PREFERRED EMBODIMENT

Figure 3:
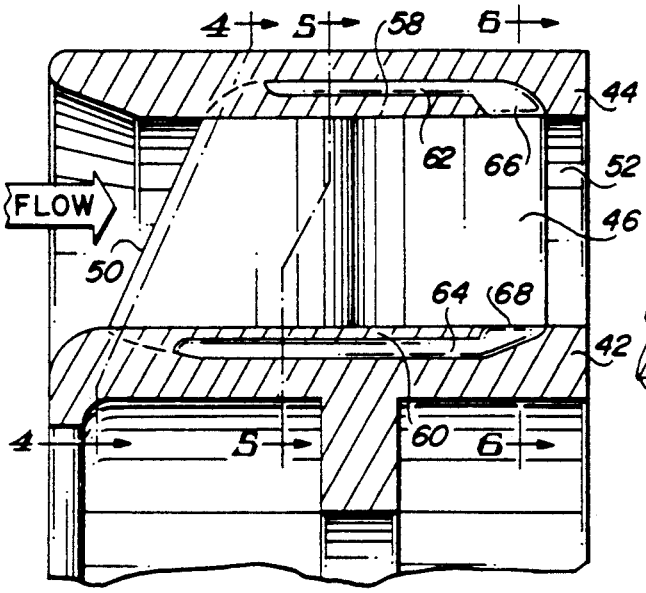
FIG. 3 is a partial schematic, cross sectional view of the stator assembly cut along a line parallel to the concave surface, but slightly spaced therefrom.

Referring to the drawings, FIG. 1 schematically depicts a gas turbine engine 10 of the type used as an auxiliary power unit. The engine 10 is comprised of a two stage compressor 18, driven by a three stage turbine 20 via an interconnecting shaft 22. A reverse flow annular combustor 24 is operably disposed between the compressor 18, and the turbine 20.

During engine operation, air is inducted through a perforated inlet housing 32 and pressurized by the compressor 18. The pressurized air flows into the combustor 24 where it is mixed with fuel supplied through fuel nozzles 36 and ignited. The hot, pressurized gas is then directed by a first stage stator 30 into the turbine 20 which extracts the energy of the gas and converts it into shaft power. Finally, the gas exits through an exhaust duct 34 into the atmosphere.

Referring to FIG. 2, which is the enlarged view of the portion of the stator 30 within the dashed circle of FIG. 1. The stator 30 is comprised of an inner shroud ring 42, an outer shroud ring 44, and a plurality of vanes 46 disposed therebetween.

In the preferred embodiment, as shown in FIGS. 3-6, each of the vanes 46 has an airfoil shape with a concave or pressure side 54 and a convex or suction side 56. The degree of concavity being referred to as the vane's camber. Following conventional blade or vane terminology, the sides 54 and 56 are bounded by a rounded leading or upstream edge 50, a thin, rounded trailing or downstream edge 52, an outer edge 58 extending between the radial, (relative to the engine centerline) outer ends of the leading and trailing edges 50,52, and a inner edge 60 extending between the radial inner ends of the leading and trailing edges 50,52. As shown in FIG. 3, the inner and outer edges 60,58 of the vane 46 are outside the flow path. Various materials can be selected for the vane 46 including corrosion resistant metal alloys, equiaxed alloys, single crystal alloys, and oxidation dispersion strengthened mechanically alloyed metals. The vanes 46 can also be improved by applying a high temperature protective coating, such as diffusion aluminide, or platinum aluminide. The coating can be applied either before or after casting. The shrouds 42 and 44 are usually made from a cobalt or nickel based alloy, but any alloy with good creep strength, low cycle fatigue strength, and corrosion resistance would be acceptable.

Figure 4:
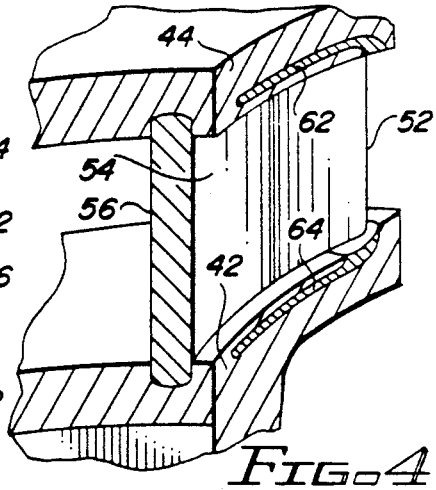
FIG. 4 is a perspective view of FIG. 3 cut along line 4—4 at the vane leading edge, looking along the flow path toward the trailing edge.
Figure 5:
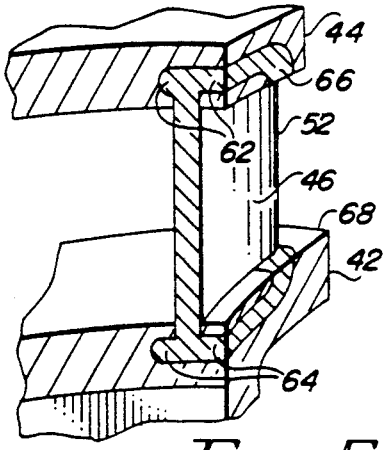
FIG. 5 is a perspective view of FIG. 3 cut along line 5—5 at the vane midsection, looking along the flow path toward the trailing edge.
Figure 7:
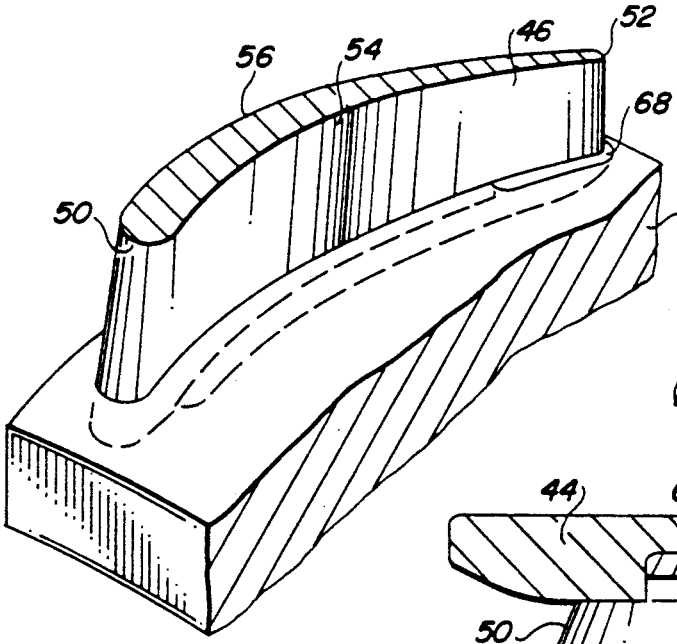
FIG. 7 is a perspective view of the bottom half of a vane cast into the shroud ring.

The inner and outer edges 60,58 each have a flange portion 64 and 62 respectfully. The flange portions 64,62 extend from the mid-chord of the vane 46 part way towards the leading and trailing edges 50,52 while following the vane's camber. Each of the flange portions 64,62 has a width greater than that of the vane 46 so has to form an overhang or lip about which conventional shroud rings 42,44 are cast. At mid-chord this width is preferably ⅔ greater than the width of the vane 46. Also, the height of the portions 64,62 is preferably ⅓ greater than the width of the vane 46. Near the leading and trailing edges 50,52, the width of the flange portions 64,62 decreases until the overhang blends into the inner and outer edges to form rounded tops and bottoms at the leading and trailing edge. The flange portions 64,62 should preferably be 50% of the curved distance from the leading edge to the trailing edge. With a length less than 25%, the flange portions are not strong enough to carry the loads between the vanes 46 and the shroud rings 42,44, and with a length greater than 90% the shroud rings 42,44 will constrain the leading and trailing edges which otherwise are not constrained after bicasting and are free to thermally grow and contract. FIG. 4 shows how the rounded ends of the leading edge are not constrained by the shroud rings 42,44. These ends are free to thermally grow or contract and thus minimizing stress concentrations.

Figure 6:
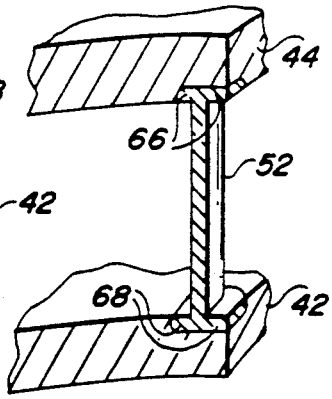
FIG. 6 is a perspective view of FIG. 3 cut along line 6—6 at the vane trailing edge, looking along the flow path.
Figure 8:
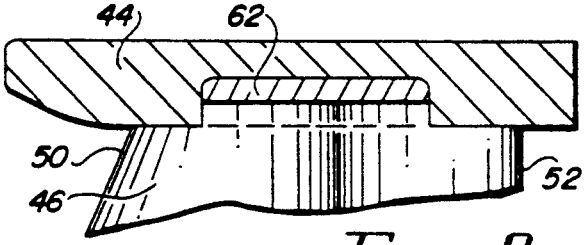
FIG. 8 is a cross section of an alternative embodiment of the present invention cut along the concave surface.

Stress relieving members 66 and 68 are formed on the vanes 46. During bicasting, the members 66 and 68 slow the temperature response thereby inhibiting the melting of the thin trailing edge 52. The stress relieving members 66 and 68 are preferably integral with the vane 46 and embrace the outer and inner edges of the trailing edge 52. As shown in FIG. 6, the members 66 and 68 rest flat against the flow side surfaces of the inner and outer shrouds 42 and 44, but are not fixed to the shroud rings. Thus, the trailing edge 52 can pull away from the shrouds 42 and 44 when cooling which reduces tensile stress. The members 66 and 68 are ellipitical to reduce the stress concentration in the shroud rings 42 and 44. Stress relieving members are not usually required on the leading edge 50 unless it is particularly thin.

In a manner familiar to those skilled in the art, by controlling the relative cooling rates of the shrouds 42,44 during the solidifying phase of the bicasting process a small gap (not shown) is formed between the shroud rings 42,44 and the flange portions 68,66. The gap allows the vane 46 to thermally grow and contract without contacting the shroud rings 42,44, thereby avoiding large thermally induced loads in the Vine and rings. The gap is preferably 0.001 to 0.002 inches per inch of inner shroud ring 42 radius.

It is not the intention of the inventors to limit the above described invention to the stator application. It is also contemplated that the invention would be useful for aft-bearing support structures, radial turbine nozzles, and other components formed from multiple material and having portions exposed to a flowing, hot gas.

Various modifications an alterations to the above described engine component will be apparent to those skilled in the art. Accordingly, the foregoing detailed description of the preferred embodiment of the invention should be considered exemplary in nature and not as limiting to the scope and spirit of the invention as set forth in the following claims.

What is claimed is:

1. In a gas turbine engine, a component comprising:
   a first ring;
   a second ring circumscribing said first ring and spaced therefrom to define a portion of a flow path in said engine; and
   a member disposed in said flow path portion and defined by a leading edge, a trailing edge, an outer edge adjacent said second ring and an inner edge adjacent said first ring, said outer and inner edges each having a flange portion about which said first and second rings are respectively cast, said flange portions extending from the mid-chord between said leading and trailing edges part way towards said leading and trailing edges.

2. The component of claim 1 wherein said flange portions have a width greater than the width of said member to define a lip, the width of said flange portions decreasing as it gets further from said midpoint until said lip blends into said o uter and inner edges respectively.

3. The component of claim 2 wherein the length of said flange portions is between 25% and 90% of the distance between said leading and trailing edge.

4. The component of claim 3 wherein the corners at which said edges meet are rounded.

5. The component of claim 4 having a gap between said flange portions and said first and second rings respectively.

6. The component of claim 5 wherein said member is an airfoil.

7. The component of claim 6 wherein said member and said rings are formed from different materials.

8. The component of claim 7 wherein said rings are formed from different materials.

9. The component of claim 1 further comprising means for inhibiting the melting of said trailing edge during said casting.

10. The component of claim 1 further comprising at least one stress relieving member embracing said trailing edge.

11. The component of claim 10 wherein said stress relieving member is integral with said trailing edge and rests flat against a flow side surface of one of said first and second rings.

* * * * *